US011517057B2

(12) United States Patent
Yoshida et al.

(10) Patent No.: US 11,517,057 B2
(45) Date of Patent: Dec. 6, 2022

(54) MASK

(71) Applicant: NITTO DENKO CORPORATION, Osaka (JP)

(72) Inventors: Kei Yoshida, Osaka (JP); Satoru Furuyama, Osaka (JP); Hajime Ooya, Osaka (JP)

(73) Assignee: NITTO DENKO CORPORATION, Osaka (JP)

( * ) Notice: Subject to any disclaimer, the term of this patent is extended or adjusted under 35 U.S.C. 154(b) by 601 days.

(21) Appl. No.: 15/576,978

(22) PCT Filed: May 27, 2016

(86) PCT No.: PCT/JP2016/002595
§ 371 (c)(1),
(2) Date: Nov. 27, 2017

(87) PCT Pub. No.: WO2016/194353
PCT Pub. Date: Dec. 8, 2016

(65) Prior Publication Data

US 2018/0160748 A1 Jun. 14, 2018

(30) Foreign Application Priority Data

Jun. 4, 2015 (JP) ..... JP2015-114118

(51) Int. Cl.
*A61D 13/00* (2006.01)
*A41D 13/11* (2006.01)
(Continued)

(52) U.S. Cl.
CPC ..... *A41D 13/11* (2013.01); *A62B 18/02* (2013.01); *A62B 23/025* (2013.01)

(58) Field of Classification Search
CPC ..... A62B 18/02; A41D 13/11–1192
(Continued)

(56) References Cited

U.S. PATENT DOCUMENTS 3,042,034 A * 7/1962 Gruenewaelder ..... A41D 13/11 128/206.12
4,004,584 A * 1/1977 Geaney ..... A62B 23/06 128/206.14
(Continued)

FOREIGN PATENT DOCUMENTS

CN 201328385 10/2009
CN 202958898 6/2013
(Continued)

OTHER PUBLICATIONS

Official Communication issued in International Bureau of WIPO Patent Application No. PCT/JP2016/002595, dated Aug. 16, 2016, along with an english translation thereof.
(Continued)

*Primary Examiner* — Adam Baker
(74) *Attorney, Agent, or Firm* — Greenblum & Bernstein, P.L.C.

(57) ABSTRACT

The mask of the present disclosure is adapted to be worn on a face including a main body that covers at least a portion of the face, and the main body includes a resin film having air permeability through the thickness thereof. The resin film is a non-porous film having through holes extending through the thickness of the film. The diameter of the through holes is 0.01 μm or more and 30 μm or less. The density of the through holes in the resin film is 10 holes/cm$^2$ or more and $1\times10^8$ holes/cm$^2$ or less. The mask of the present disclosure is completely different in structure from conventional masks, has high flexibility in the design of various properties such as shielding ability, air permeability, transparency, and sound permeability, and is capable, for example, of exhibiting high shielding ability, high air permeability, high transparency, and high sound permeability.

13 Claims, 6 Drawing Sheets

(51) Int. Cl.
*A62B 18/02* (2006.01)
*A62B 23/02* (2006.01)

(58) Field of Classification Search
USPC ..... 128/863
See application file for complete search history.

(56) References Cited

U.S. PATENT DOCUMENTS 4,467,799 A * 8/1984 Steinberg ..... A41D 13/1176 128/206.25
4,832,997 A * 5/1989 Balanzat ..... B01D 67/0032 216/66
5,727,544 A * 3/1998 Miura ..... A41D 13/11 128/201.13
5,863,312 A * 1/1999 Wolfe ..... A41D 13/11 55/495
2009/0044809 A1 2/2009 Welchel et al.
2010/0239625 A1 9/2010 Puckett et al.
2011/0232653 A1* 9/2011 Imashiro ..... A41D 13/1192 128/863
2011/0296584 A1 12/2011 Kuo
2012/0167891 A1* 7/2012 Smaller ..... A41D 13/11 128/206.19
2017/0106217 A1* 4/2017 Kuhn ..... A41D 13/1192

FOREIGN PATENT DOCUMENTS

| | | |
|---|---|---|
| CN | 104432701 | 3/2015 |
| JP | 60-017760 | 2/1985 |
| JP | 10-211294 | 8/1998 |
| JP | 2004-351190 | 12/2004 |
| JP | 2007-014576 | 1/2007 |
| JP | 2009-011475 | 1/2009 |
| JP | 2013-046647 | 3/2013 |
| JP | 2013-066643 | 4/2013 |

OTHER PUBLICATIONS

Extended European Search Report issued in European Patent Office (Epo) Patent Application No. 16802795.1, dated Nov. 27, 2018.

* cited by examiner

Example 1

Comparative Example 1

MASK

TECHNICAL FIELD

The present invention relates to masks adapted to be worn on faces and more particularly relates to a mask that protects the wearer from substances such as powder dust, droplets, contaminants, allergens, and pathogens and prevents dispersal of substances such as droplets and pathogens due to breathing, coughing, or sneezing of the wearer and that at the same time ensures breathing of the wearer.

BACKGROUND ART

Masks adapted to be worn on faces are widely used in various situations including daily life, and the amounts of their production and consumption are increasing year after year. For example, workers at the sites of industrial production or at the sites of civil engineering and construction use masks to avoid inhaling substances such as powder dust (fine particles), droplets, and contaminants. In the medical field, medical workers and patients use masks to avoid inhaling substances such as droplets, contaminants, pathogens, and allergens typified by pollen and also to prevent substances such as droplets, contaminants, and pathogens from dispersing into the surroundings due to breathing, coughing, or sneezing of the workers or patients. Nowadays, masks are becoming widely used in daily life to avoid inhalation of allergens and contaminants such as "PM 2.5", and are becoming increasingly used also in service businesses such as manufacturing and supply of foods to prevent dispersal of droplets from the wearers or to create the impression of cleanliness.

An exemplary mask includes: a main body that covers at least a portion of the face of a wearer, typically the nostrils and mouth of the wearer; and an engaging portion that holds the main body in position on the face of the wearer. The main bodies used in conventional masks are commonly composed of a non-woven fabric or woven fabric. The non-woven fabric or woven fabric ensures breathing of the wearer by its air permeability and also functions as a filter to prevent inhalation of substances as mentioned above by the wearer and/or dispersal of the substances from the wearer.

A main body composed of a non-woven fabric or woven fabric is typically non-transparent, and the portion of the wearer's face that is covered by the mask is concealed. However, masks may, depending on their application, be desired to have a main body that is as transparent as possible; specifically, for example, when a medical worker who has face-to-face contact with patients or a service business worker who works before the eyes of customers uses a mask, the main body of the mask is desirably as transparent as possible to prevent the patients or customers from feeling discomfort or failing to identify the wearer because of the concealment of a portion of the face of the wearer or to establish good communication by allowing the patients or customers to see the facial expression of the wearer. To produce such a main body, a transparent resin film or a very thin woven fabric or non-woven fabric has been conventionally used. Masks having a transparent main body are disclosed, for example, in Patent Literatures 1 to 3.

CITATION LIST

Patent Literature

Patent Literature 1: JP 2009-11475 A
Patent Literature 2: JP 2013-46647 A
Patent Literature 3: JP 2013-66643 A

SUMMARY OF INVENTION

Technical Problem

A mask having a main body composed of a very thin woven fabric or non-woven fabric has a reduced ability to protect the wearer from substances such as powder dust and a reduced ability to prevent dispersal of substances such as droplets from the wearer (these abilities may be collectively referred to as "shielding ability" hereinafter). Additionally, scattering of light by fibers constituting the woven fabric or non-woven fabric makes it practically difficult to achieve high transparency.

A main body composed of a transparent resin film can have a high shielding ability by itself and can, when the material of the film is appropriately selected, be provided with high transparency. However, since the resin film itself lacks air permeability, provision of a gap between the face of the wearer and the main body may be inevitably needed to ensure breathing of the wearer and may result in a reduction in the shielding ability of the mask. The lack of air permeability of the resin film may also cause a need to combine the resin film with an air-permeable portion for ensuring breathing of the wearer as seen in masks disclosed in Patent Literatures 2 and 3 (the air-permeable portion in the masks of Patent Literatures 2 and 3 is a non-woven fabric portion). Furthermore, covering of the nostrils and mouth of the wearer by the resin film serving as the main body makes the utterances of the wearer less audible. This is not very desirable, particularly for use by medical workers or service business workers. The masks of Patent Literatures 2 and 3 still have a disadvantage in terms of sound permeability.

As described above, the broadening of the range of applications of masks and the recent social demands have created a situation where masks are required to have various properties such as transparency and sound permeability in addition to shielding ability and air permeability for ensuring breathing of the wearers.

It is an object of the present invention to provide a mask completely different in structure from conventional masks, the mask having high flexibility in the design of various properties such as shielding ability, air permeability, transparency, and sound permeability and being capable, for example, of exhibiting high shielding ability, high air permeability, high transparency, and high sound permeability simultaneously.

Solution to Problem

The mask according to the present invention is a mask adapted to be worn on a face and including a main body that covers at least a portion of the face, and the main body includes a resin film having air permeability through the thickness thereof. The resin film is a non-porous film having through holes extending through the thickness of the film. The diameter of the through holes is 0.01 μm or more and 30 μm or less. The density of the through holes in the resin film is 10 holes/$cm^2$ or more and $1\times10^8$ holes/$cm^2$ or less.

Advantageous Effects of Invention

The present invention makes it possible to obtain a mask completely different in structure from conventional masks, the mask having high flexibility in the design of various properties such as shielding ability, air permeability, transparency, and sound permeability and being capable, for example, of exhibiting high shielding ability, high air permeability, high transparency, and high sound permeability.

DESCRIPTION OF EMBODIMENTS

A first aspect of the present disclosure provides a mask adapted to be worn on a face, the mask including a main body that covers at least a portion of the face, wherein the main body includes a resin film having air permeability through the thickness thereof, the resin film is a non-porous film having through holes extending through the thickness of the film, the diameter of the through holes is 0.01 μm or more and 30 μm or less, and the density of the through holes in the resin film is 10 holes/$cm^2$ or more and $1\times10^8$ holes/$cm^2$ or less.

A second aspect of the present disclosure provides the mask as set forth in the first aspect, wherein the resin film is composed of a transparent material.

A third aspect of the present disclosure provides the mask as set forth in the first or second aspect, wherein the through holes extend in a direction perpendicular to a principal surface of the resin film.

A fourth aspect of the present disclosure provides the mask as set forth in any one of the first to third aspects, wherein a ratio t/R is 1 or more and 10000 or less, where R denotes the diameter of the through holes and t denotes the thickness of the resin film.

A fifth aspect of the present disclosure provides the mask according to any one of the first to fourth aspects, wherein an air permeability through the thickness of the resin film, as determined by Frazier number measured according to JIS L 1096, is 10 $cm^3/(cm^2\cdot sec)$ or more.

A sixth aspect of the present disclosure provides the mask as set forth in any one of the first to fifth aspects, wherein a sound pressure loss across the resin film at a frequency of 1 kHz is 5 dB or less.

A seventh aspect of the present disclosure provides the mask as set forth in any one of the first to sixth aspects, wherein a total light transmittance of the resin film, as measured according to JIS K 7361, is 60% or more.

An eighth aspect of the present disclosure provides the mask as set forth in any one of the first to seventh aspects, wherein the resin film is composed of at least one material selected from polyethylene terephthalate, polycarbonate, polyimide, polyethylene naphthalate, and polyvinylidene fluoride.

Figure 1:
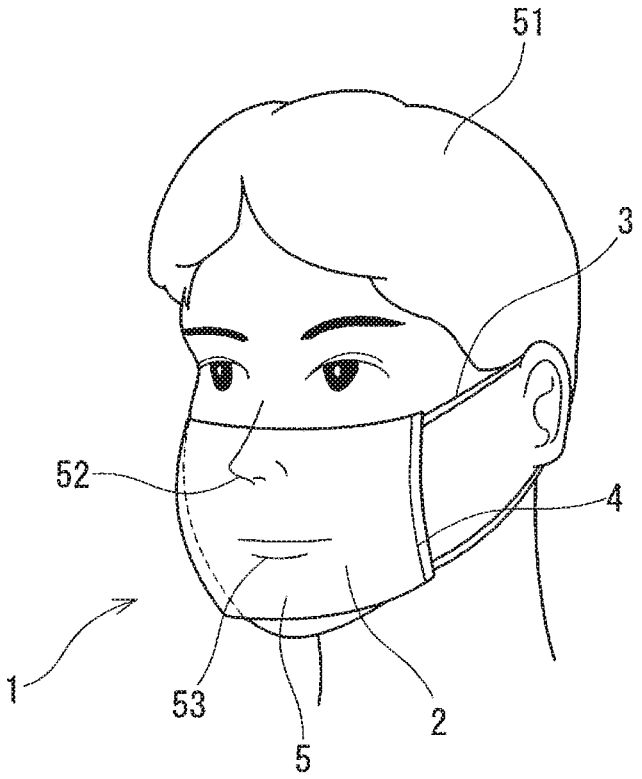
FIG. 1 is a perspective view schematically showing an example of the mask according to the present invention.

FIG. 1 shows an example of the mask according to the present invention which is worn on the face of a wearer. A mask 1 shown in FIG. 1 includes: a main body 2 that covers a portion, specifically nostrils 52 and mouth 53, of the face of a wearer 51; and an engaging portion 3 for holding the main body 2 in position on the face of the wearer 51. The engaging portion 3 is joined to the main body 2 at the edge 4 of the main body 2. In the mask 1, the engaging portion 3 is a string-shaped member. The engaging portion 3 is looped around the ear of the wearer 51 when the mask 1 is worn on the face of the wearer 51. In the mask 1, the main body 2 is composed of a resin film 5. The resin film 5 has air permeability through its thickness.

Specifically, the resin film 5 is a non-porous film having through holes extending through the thickness of the film. The diameter of the through holes is 0.01 μm or more and 30 μm or less, and the density of the through holes (hole density) in the resin film 5 is 10 holes/$cm^2$ or more and $1\times10^8$ holes/$cm^2$ or less.

The mask 1, in which the main body 2 includes the resin film 5, can ensure breathing of the wearer 51 even when the peripheral portion of the main body 2 is in close contact with the face of the wearer 51. Additionally, the fact that the diameter and density of the through holes in the resin film 5 are within predetermined ranges allows the mask 1 to exhibit high shielding ability and high sound permeability. The use of a transparent material in the resin film 5 can impart transparency to the main body 2 and the mask 1 including the main body 2. That is, the mask 1 can, for example, exhibit high shielding ability, high air permeability, high transparency, and high sound permeability simultaneously.

Additionally, for example, the resin film 5 can be suitably subjected to various processes such as liquid-repellent treatment, coloring treatment, anti-fogging treatment, and printing which is limited when performed on non-woven fabrics or woven fabrics. These processes can impart various properties and/or functions to the main body 2 and the mask 1 including the main body 2. Various properties, including the above-mentioned four properties, of the mask 1 having the main body 2 including the resin film 5 can be altered depending on the selection of whether to perform the above processes and the selection of the types of the processes and also depending on the selection of the material and/or thickness of the resin film 5, the control of the diameter and density of the through holes, and the control of the direction in which the through holes extend through the resin film 5. That is, the mask 1 is a mask having high flexibility in the design of various properties such as shielding ability, air permeability, transparency, and sound permeability.

Figure 2:
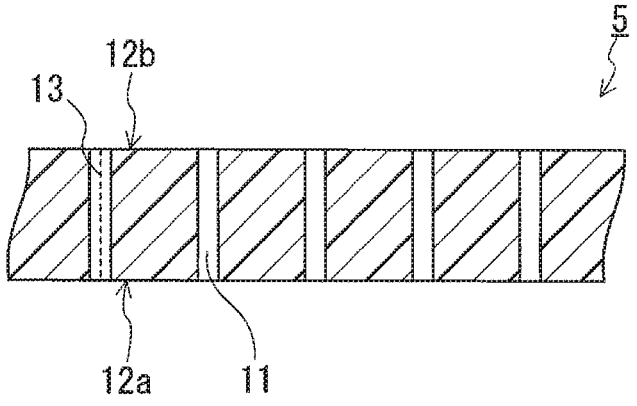
FIG. 2 is a cross-sectional view schematically showing an exemplary resin film usable in the main body of the mask according to the present invention.

FIG. 2 shows an example of the resin film 5. The resin film 5 has through holes 11 formed to penetrate the thickness of the resin film 5. The through holes 11 extend straight, and the area of their cross-section perpendicular to the direction in which they extend (this cross-section may be simply referred to as "cross-section of the through hole(s)" hereinafter) is constant from a first principal surface 12*a* of the resin film 5 to a second principal surface 12*b* of the resin film 5. The through holes 11 pierce a substrate structure of the resin film 5. In other words, the through holes 11 have a different structure from the substrate of the resin film 5. The resin film 5 is a non-porous film having no passage that allows through-thickness air permeation other than the through holes 11, and is typically an imperforate (solid) film except for the through holes 11. That is, the substrate structure of the resin film 5 is non-porous, and the through holes 11 pierce this non-porous porous structure. The through holes 11 are straight holes having a central axis (axial line) 13 extending straight.

The through holes 11 can be formed, for example, by ion beam irradiation and subsequent chemical etching of an original film of the resin film 5 or by laser irradiation of the original film. The resin film 5 can be a film obtained by ion beam irradiation and chemical etching of an original film or can be a film obtained by laser irradiation of an original film.

The structure of this resin film 5 is significantly different from the structures of woven fabrics and non-woven fabrics which have commonly been used in main bodies of masks. In woven fabrics and non-woven fabrics, random interstices present between fibers act as air passages, which means that the air passages have a huge number of branches and junctions and can never be straight holes. With the use of a woven fabric or non-woven fabric, high transparency is practically difficult to achieve because strong light scattering inevitably occurs due to the random interstices. Woven fabrics and non-woven fabrics can be considered to have a substrate structure which itself is a porous structure.

In the resin film 5, especially in the resin film 5 produced by ion beam irradiation and chemical etching of an original film or by laser irradiation of an original film, a large number of through holes 11 whose diameters (opening diameters) are uniform (through holes 11 having high uniformity in diameter) can be formed in the substrate structure which is a non-porous structure. The high uniformity in diameter of the through holes 11 formed in the non-porous substrate structure contributes, for example, to reliably making the simultaneous achievement of high levels of shielding ability, air permeability, and sound permeability of the mask 1 having the main body 2 including the resin film 5. When the resin film 5 is composed of a transparent material, the high uniformity in diameter of the through holes 11 contributes to reducing the light scattering in the resin film 5 and therefore to imparting higher transparency to the mask 1. Further, since the through holes 11 are formed to penetrate the non-porous substrate structure of the resin film 5, not only the diameter of the through holes 11 but also other features such as the shape characteristics (including the cross-sectional shape and the way of change in cross-sectional area) and the density of the through holes 11 in the resin film 5 can be controlled more accurately and uniformly. This also helps the mask 1 to have higher flexibility in the design of various properties such as shielding ability, air permeability, transparency, and sound permeability.

The diameter of the through holes 11 is 0.01 μm or more and 30 μm or less. When the diameter is within this range, the flexibility in the design of the above various properties is high. As for the shielding ability of the mask 1, given that the size of viruses is about 0.1 to 1 μm, the size of droplets containing bacteria and viruses or the size of bacteria is about 1 to 10 μm, the size of pollen is about 30 μm, the size of contaminants (particles) such as PM 2.5 is about 0.1 to a dozen μm, and the size of common powder dust is greater than such contaminants, the mask 1 having the main body 2 including the resin film 5 can be understood to be adequate to shield against these substances. The diameter of the through holes 11 can be theoretically reduced to less than 0.01 μm. However, such a reduction in the diameter of the through holes 11 deteriorates the efficiency of industrial production of the resin film 5, and the diameter less than 0.01 μm is considered too small in view of the size of viruses. Furthermore, if the diameter of the through holes 11 is less than 0.01 μm, it is difficult to allow the mask 1 having the main body 2 including the resin film 5 to have a good balance between the properties, in particular between shielding ability and air permeability. If the diameter of the through holes 11 is more than 30 μm, the shielding ability of the mask 1 having the main body 2 including the resin film 5 decreases.

The density of the through holes 11 (hole density) in the resin film 5 is 10 holes/cm$^2$ or more and $1\times10^8$ holes/cm$^2$ or less. This, coupled with the fact that the diameter of the through holes 11 is 0.01 μm or more and 30 μm or less, can offer the high flexibility in the design of the above various properties, thus making it possible, for example, to achieve high shielding ability, high air permeability, and high sound permeability and allowing the mask 1 to exhibit higher transparency when it is transparent.

The diameter of the through holes 11 is different in concept from the average hole diameter of the resin film 5. In the resin film 5, the diameters (opening diameters) of all of the through holes 11 present in the principal surfaces 12*a* and 12*b* or the diameters of all of the through holes 11 present in the effective region of the resin film 5 (the region usable for the intended application of the film) can be within the range described above.

The shapes of the cross-section and opening of the through holes 11 are not particularly limited and axe, for example, circular or elliptical. In this case, the shapes need not be exactly circular or elliptical and, for example, some degree of shape distortion inevitably caused due to the nature of the production methods described below is acceptable.

The diameter of a through hole 11 is determined as the diameter of a circle on the assumption that the opening of the through hole has the shape of the circle. In other words, the diameter of a through hole 11 is defined as corresponding to the diameter of a circle having an area equal to the cross-sectional area (opening area) of the opening of the through hole. The diameters of the openings of the through holes 11 in the principal surface 12*a* or 12*b* of the resin film 5 need not be exactly equal for all of the openings of the through holes 11 present in the principal surface. However, it is preferable for the diameters in the effective region of the resin film 5 to be so uniform that the diameters can be considered substantially equal (e.g., the standard deviation is 10% or less of the average). The production methods described below are capable of producing the resin film 5 in which the openings of the through holes 11 have such uniform diameters.

A through hole 11 extending obliquely to the direction perpendicular to the principal surfaces 12*a* and 12*b* of the resin film 5 can have an opening of elliptical shape. Also in such a case, the cross-section of the through hole 11 inside the film 5 can be considered to be in the shape of a circle, and the diameter of this circle is equal to the minor axis of the ellipse corresponding to the shape of the opening. Thus, for the through hole 11 extending obliquely and having an opening of elliptical shape, the minor axis of the ellipse can be regarded as the opening diameter of the through hole.

The density of the through holes 11 in the resin film 5 need not be exactly constant over the entire resin film 5. However, the density in the effective region is preferably so uniform that the maximum value of the density is equal to or less than 1.5 times the minimum value of the density. The density of the through holes 11 can be determined, for example, by observing the surface of the resin film 5 with a microscope and analyzing the microscopic image.

Depending on the production method of the resin film 5, "burrs" may be formed around the openings of the through holes 11 in the principal surfaces of the resin film 5. The characteristics of the resin film 5 which are related to the openings of through holes 11, such as the opening diameter, are determined solely on the basis of the openings themselves irrespective of the burrs.

In the example shown in FIG. 2, the area of the cross-section of the through holes 11 is constant from the first principal surface 12*a* to the second principal surface 12*b*. The through holes 11 may have a shape in which the area of the cross-section changes from the first principal surface 12*a* of the resin film 1 toward the second principal surface 12*b* of the resin film and may have, for example, a shape in which the area of the cross-section increases from the first principal surface 12*a* toward the second principal surface 12*b* (see FIG. 3 for the shape in which the area of the cross-section increases). Such through holes 11 have a shape that is asymmetric across the thickness of the resin film 5 and in which the cross-section varies in the direction in which the through holes 11 extend. In the case where the diameter of the through holes 11 is different between the two principal surfaces of the resin film 5, such as when the area of the cross-section of the through holes 11 increases from the first principal surface 12*a* toward the second principal surface 12*b*, the diameter of the through holes 11 in the principal surface where the area of the openings of the through holes is relatively small may be 0.01 μm or more and 30 μm or less, and the density of the through holes 11 in the principal surface may be 10 holes/$cm^2$ or more and $1\times10^8$ holes/$cm^2$ or less. When the area of the cross-section of the through holes 11 increases from the first principal surface 12*a* toward the second principal surface 12*b*, the area may increase continuously from the first principal surface 12*a* toward the second principal surface 12*b* or may increase stepwise from the first principal surface 12*a* toward the second principal surface 12*b* (this means that there may be a region where the area is constant). In an embodiment, the area of the cross-section increases continuously, and the rate of the increase is constant or substantially constant. When the shape of the cross-section is circular or elliptical and the area of the cross-section increases from the first principal surface 12*a* toward the second principal surface 12*b* at a constant rate or at a substantially constant rate, the shape of the through holes 11 corresponds to a circular cone, an elliptical cone, or a part of one of the cones. The production methods described below are capable of producing the resin film 5 having such through holes 11.

When the area of the cross-section of the through holes 11 increases from the first principal surface 12*a* toward the second principal surface 12*b*, the ratio a/b of the smaller diameter a of the through holes 11 in the principal surface 12*a* to the larger diameter b of the through holes 11 in the principal surface 12*b* is, for example, 80% or less, and can be 75% or less or even 70% or less. The lower limit of the ratio a/b is not particularly defined, and is, for example, 10%.

In view of the transparency of the mask 1 having the main body 2 including the resin film 5, the area of the cross-section of the through holes 11 is preferably constant from the first principal surface 12*a* to the second principal surface 12*b*. This reduces light scattering due to the presence of the through holes 11. Saying that the area of the cross-section of the through holes 11 is constant does not necessarily mean that the area of the cross-section should be exactly constant. Some variation in the area of the cross-section inevitably caused due to the nature of the production method of the resin film 5 is acceptable.

In the example shown in FIG. 2, the direction in which the through holes 11 extend is a direction perpendicular to the principal surfaces 12*a* and 12*b* of the resin film 5. As long as the through holes 11 penetrate the thickness of the resin film 5, the direction in which the through holes 11 extend may be oblique to the direction perpendicular to the principal surfaces 12*a* and 12*b* of the resin film 5. In the resin film 5, there may be both through holes 11 extending in the direction perpendicular to the principal surfaces 12*a* and 12*b* and through holes 11 extending in a direction oblique to the perpendicular direction. In view of the transparency of the mask 1 having the main body 2 including the resin film 5, it is preferable that the through holes 11 extend in the direction perpendicular to the principal surfaces 12*a* and 12*b* of the resin film 5 as in the example shown in FIG. 2.

All of the through holes 11 present in the resin film 5 may extend in the same direction (the directions of the central axes 13 may be uniform). Alternatively, as shown in FIG. 4, the resin film 5 may have through holes 11 (11*a* to 11*g*) extending in directions oblique to the direction perpendicular to the principal surfaces 12*a* and 12*b* of the film, and there may be through holes that extend in the first oblique direction and through holes that extend in the second oblique direction different from the first oblique direction.

Figure 4:
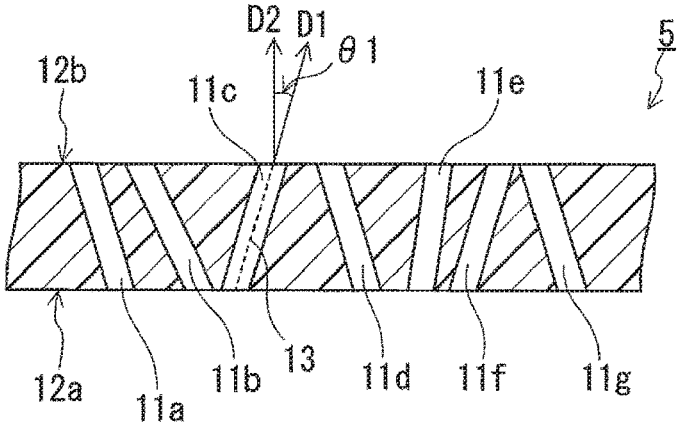
FIG. 4 is a cross-sectional view schematically showing still another exemplary resin film usable in the main body of the mask according to the present invention.

In the example shown in FIG. 4, through holes 11 extend obliquely to the direction perpendicular to the principal surfaces 12*a* and 12*b* of the resin film 5, and there is a combination of through holes 11 extending in different directions. In this case, the resin film 5 may have a combination of through holes 11 extending in the same direction (the through holes 11*a*, 11*d*, and 11*g* extend in the same direction in the example shown in FIG. 4). The term "set" may hereinafter be used instead of "combination". The term "set" is used not only to refer to the relationship (a pair) between one through hole and another through hole but also to refer to the relationship between one or more through holes and one or more other through holes. Saying that there is a set of through holes having the same characteristics means that there are two or more through holes having the characteristics.

For example, the properties of the resin film 5 as shown in FIG. 4 which has through holes 11 extending in different oblique directions can be controlled in a different range than the properties of another type of resin film 5. This also contributes to increasing the flexibility in the design of various properties of the mask according to the present invention.

For the through holes 11 shown in FIG. 4, the angle θ1 formed by the oblique direction D1 in which the holes extend (the direction of the central axis 13) with the direction D2 perpendicular to the principal surfaces of the resin film 5 is, for example, 45° or less and can be 30° or less. When the angle θ1 is within these ranges, the flexibility in the design of various properties of the mask 1 is further increased. If, for example, the angle θ1 is excessively large, the transparency of the mask 1 tends to be low due to strong light scattering in the resin film 5. Further, in this case, the mechanical strength of the resin film 5 tends to be low. The lower limit of the angle θ1 is not particularly defined. The through holes 11 in FIG. 4 include a set of through holes for which the angles θ1 are different.

When the resin film 5 as shown in FIG. 4 which has through holes 11 extending in different oblique directions is viewed in a direction perpendicular to a principal surface of the resin film 5 (when the directions in which the through holes 11 extend are projected onto the principal surface), the projected directions in which the through holes 11 extend may be parallel to each other. Alternatively, the resin film 5 may have a set of through holes 11 extending in a first projected direction and through holes 11 extending in a second projected direction different from the first projected direction (which means that through holes 11 for which the projected directions are different from each other may coexist in the resin film 5).

Figure 5:
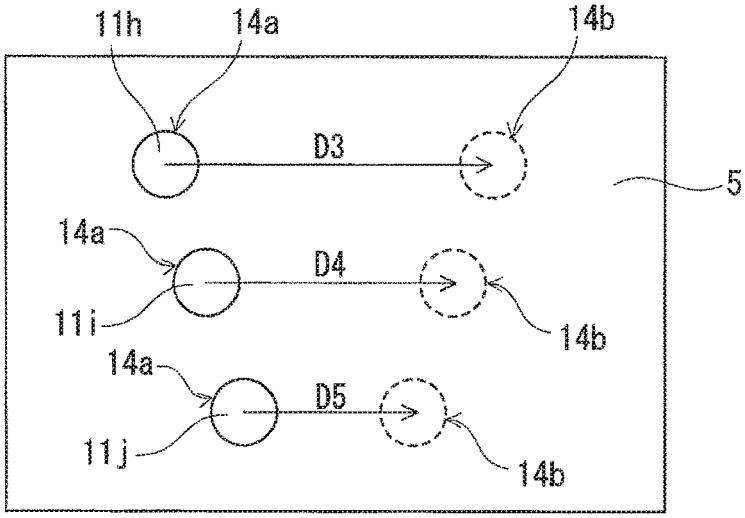
FIG. 5 is a plan view schematically showing still another exemplary resin film usable in the main body of the mask according to the present invention.

FIG. 5 shows an example where the directions in which the through holes 11 extend when viewed in a direction perpendicular to a principal surface of the resin film 5 are parallel to each other. In the example shown in FIG. 5, there can be seen three through holes 11 (11*h*, 11*i*, and 11*j*). In the view taken in a direction perpendicular to a principal surface of the resin film 5, the directions D3, D4, and D5 in which the three through holes 11 respectively extend (the directions from openings 14*a* of the through holes 11 in the principal surface depicted on the sheet plane toward openings 14*b* of the through holes 11 in the opposite principal surface) are parallel to each other (this means that 02 described later is 0°). It should be noted that the angles θ1 formed by the through holes 11*h*, 11*i*, and 11*j* are different from each other. The angle θ1 formed by the through hole 11*j* is smallest, and the angle θ1 formed by the through hole 11*h* is largest. Thus, the directions in which the through holes 11*h*, 11*i*, and 11*j* extend are different from each other in three dimensions.

Figure 6:
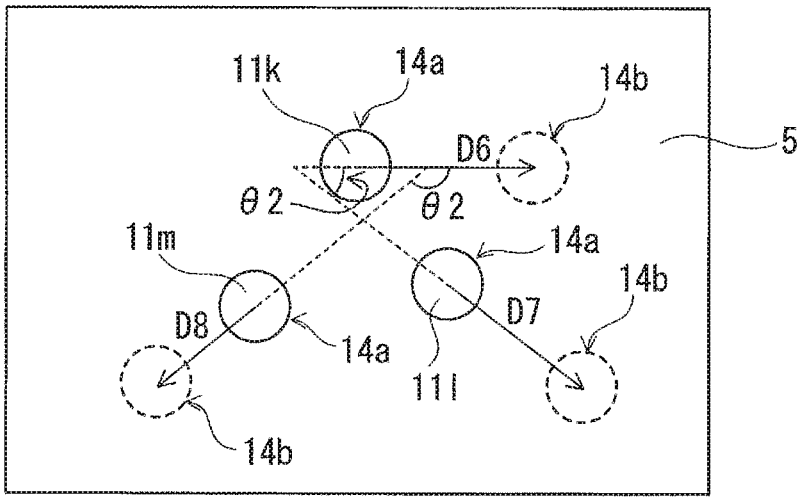
FIG. 6 is a plan view schematically showing a different exemplary resin film usable in the main body of the mask according to the present invention.

FIG. 6 shows an example where the directions in which the through holes 11 extend when viewed in a direction perpendicular to a principal surface of the resin film 5 are different from each other. In the example shown in FIG. 6, there can be seen three through holes 11 (11*k*, 11*l*, and 11*m*). In the view taken in a direction perpendicular to a principal surface of the resin film 5, the directions D6, D7, and D8 in which the three through holes 11 respectively extend are different from each other. When viewed in a direction perpendicular to a principal surface of the resin film 5, the through holes 11*k* and 11*l* extend from the principal surface in different directions forming an angle θ2 of less than 90°. In contrast, the through holes 11*k* and 11*m* extend from the principal surface of the resin film 5 in different directions forming an angle θ2 of 90° or more when viewed in the direction perpendicular to the principal surface of the resin film 5. The resin film 5 may have the latter set of through holes 11 which, when viewed in a direction perpendicular to a principal surface of the film, extend from the principal surface in different directions forming an angle θ2 of 90° or more. In other words, the resin film 5 may, when viewed in a direction perpendicular to a principal surface of the film, have a set of the through hole 11*k* extending from the principal surface in one direction D6 and the through hole 11*m* extending from the principal surface in another direction D8 forming an angle θ2 of 90° or more with the one direction D6. The angle θ2 is, for example, 90° or more and 180° or less; namely, the angle θ2 may be 180°.

Figure 7:
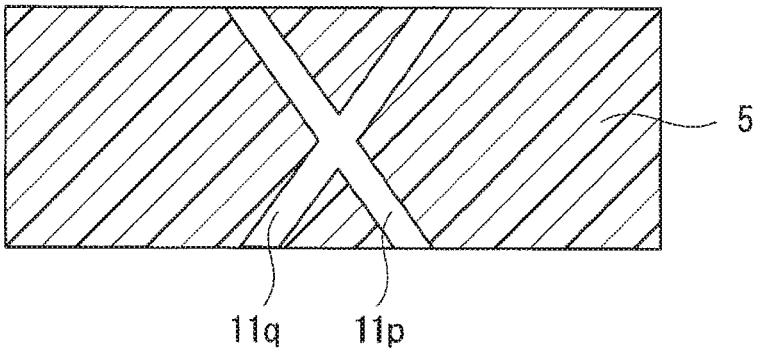
FIG. 7 is a cross-sectional view schematically showing a different exemplary resin film usable in the main body of the mask according to the present invention.

In the resin film 5 as shown in FIG. 6 which has the through holes 11 extending in different oblique directions, two or more of the through holes 11 may cross each other at the inside of the resin film 5. That is, the resin film 5 may have a set of through holes 11 crossing each other at the inside of the film 5. Such an example is shown in FIG. 7. In the example shown in FIG. 7, the through holes 11*p* and 11*q* cross each other at the inside of the resin film 5.

The directions in which the through holes 11 extend in the resin film 5 (the directions of the central axes 13 of the through holes 11) can be confirmed, for example, by observing the principal surfaces and a cross-section of the film 5 with a scanning electron microscope (SEM).

The above characteristics of the through holes 11 of the resin film 5 can be freely combined. This also contributes to the high flexibility in the design of various properties of the mask 1.

An air permeability through the thickness of the resin film 5, as determined by Frazier number measured according to JIS L 1096, can be 10 $cm^3/(cm^2 \cdot sec)$ or more. When the through-thickness air permeability is within this range, the flexibility in the design of various properties of the mask 1 having the main body 2 including the resin film 5 is further increased; for example, higher levels of shielding ability, air permeability, transparency, and sound permeability can be achieved.

Figure 3:
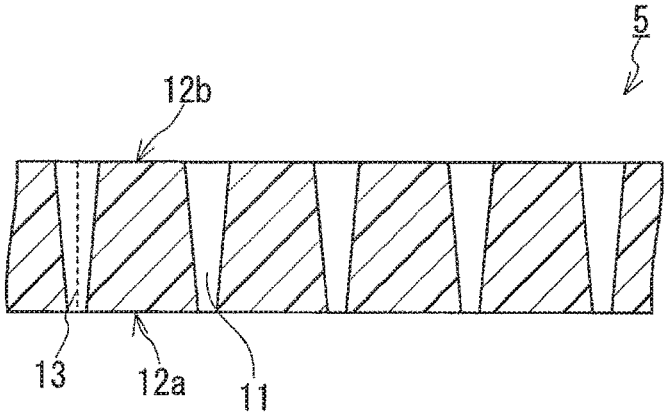
FIG. 3 is a cross-sectional view schematically showing another exemplary resin film usable in the main body of the mask according to the present invention.

When the diameter of the through holes 11 in the first principal surface 12*a* and the diameter of the through holes 11 in the second principal surface 12*b* are different from each other as shown in FIG. 3, the Frazier air permeability of the resin film 5 in the direction from the principal surface 12*b* where the diameter of the through holes 11 is larger to the principal surface 12*a* where the diameter of the through holes 11 is smaller can be within the range described above.

The variation in the air permeability of the resin film 5 is small. For example, when the Frazier air permeability is measured at 40 randomly selected points on the resin film 5, the ratio σ/Av (air permeability variation index σ/Av), where Av and σ respectively denote the average and the standard deviation of the measured values, is 0.3 or less. The variation index can be 0.2 or less or even 0.1 or less. With the use of a non-woven fabric or woven fabric, such a low air permeability variation index cannot be achieved. The fact that the air permeability variation index is low contributes to increasing the flexibility in the design of various properties of the mask 1 having the main body 2 including the resin film 5 and also contributes to improving the performance stability of the mask 1 and increasing the production yield of the mask 1. These contributions are significant especially in the case where the area over which the resin film 5 is used is small, such as when the resin film 5 is included only in a portion of the main body 2.

In the resin film 5, the variation in the density of the through holes 11 can be small. For example, the variation in the density of the through holes 11 can be 1000 holes/$cm^2$ or less. Such a small variation in the density can provide the same effect as the small variation in the air permeability. The variation in the density of the through holes 11 can be 500 holes/cm$^2$ or less. The variation in the density of the through holes 11 can be particularly reduced when the resin film 5 is obtained by forming the through holes 11 through laser irradiation of an original film.

The variation in the density of the through holes 11 can be determined as follows: the density of the through holes 11 is measured at five randomly selected points on a principal surface of the resin film 5 to be evaluated, and the variation in the density of the through holes 11 is evaluated as the ratio σ/Av, where Av and σ respectively denote the average and the standard deviation of the measured density values.

Figure 8:
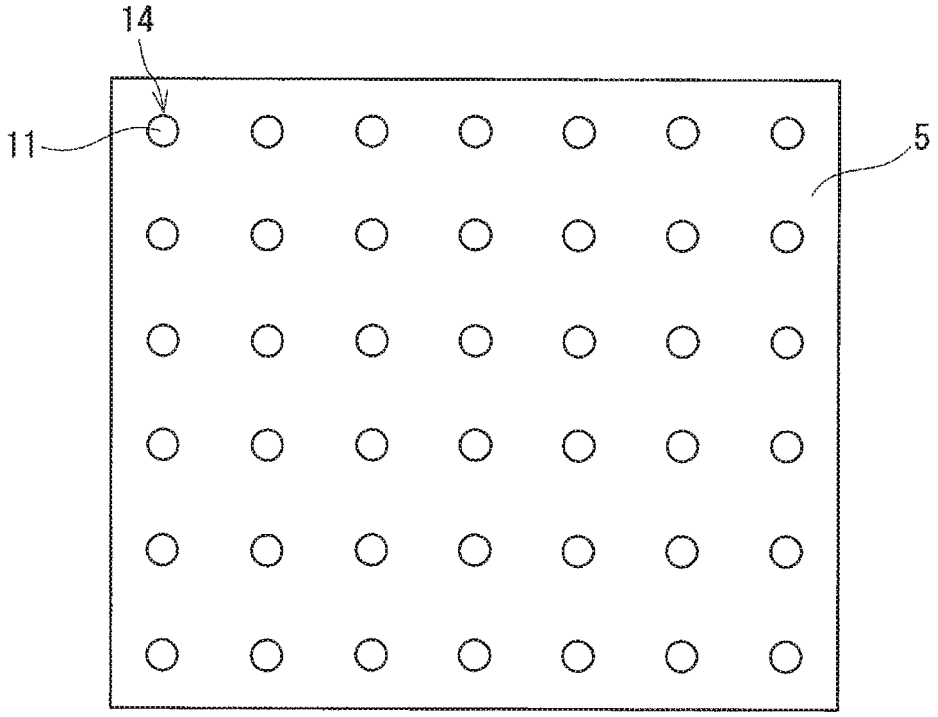
FIG. 8 is a plan view schematically showing a different exemplary resin film usable in the main body of the mask according to the present invention.

The openings of the through holes 11 can be formed independently of each other and spaced from each other in the principal surfaces of the resin film 5. An example of such a resin film 5 is one obtained by forming the through holes 11 through laser irradiation of an original film. In other words, the resin film 5 can be a film where the openings of different through holes 11 do not overlap each other in the principal surfaces of the resin film 5. In the case of such a resin film 5, the shape, diameter, and density etc. of the through holes 11 can be controlled more accurately and uniformly. In a specific example, the through holes 11 can be formed at positions corresponding to intersections of an imaginary grid defined on each of the principal surfaces. The below-described method for producing the resin film 5 by laser irradiation of an original film is capable of relatively easily forming the through holes 11 at positions corresponding to intersections of an imaginary grid. When the through holes 11 are thus arranged, the variation in the interval (pitch) between the openings is so small that the variation in the air permeability of the resin film 5 can be further reduced. The imaginary grid is not particularly limited and is, for example, a parallelogram grid, hexagonal grid, square grid, rectangular grid, or rhombic grid. These grids have parallelogram meshes, hexagonal meshes, square meshes, rectangular meshes, and rhombic (face-centered rectangular) meshes, respectively. FIG. 8 shows an example of such a resin film 5. In the resin film 5 shown in FIG. 8, the openings 14 of the through holes 11 are formed at positions corresponding to intersections of an imaginary square grid defined on the principal surfaces of the resin film 5.

In the resin film 5, the openings of different through holes 11 may overlap each other in the principal surfaces of the resin film 5. Such a resin film 5 can be produced when, as described below, the through holes 11 are formed by ion beam irradiation and chemical etching of an original film.

The open area ratio in the resin film 5 (the ratio of the sum of the areas of the openings of the through holes 11 in a principal surface to the area of the principal surface) is, for example, 50% or less, and can be 5% or more and 45% or less, 10% or more and 45% or less, or 20% or more and 40% or less. When the open area ratio is within these ranges, the flexibility in the design of various properties of the mask 1 having the main body 2 including the resin film 5 is further increased. The open area ratio can be determined, for example, by observing the surface of the resin film 5 with an microscope and analyzing the microscopic image.

When the diameter of the through holes 11 in the first principal surface 12*a* and the diameter of the through holes 11 in the second principal surface 12*b* are different from each other as shown in FIG. 3, the open area ratio and/or the variation in the density of the through holes 11 in the principal surface 12*a* where the diameter of the through holes 11 is smaller can be within the range described above.

The porosity of the resin film 5 is, for example, 5% or more and 45% or less and can be 30% or more and 40% or less. When the porosity is within these ranges, the flexibility in the design of various properties of the mask 1 having the main body 2 including the resin film 5 is further increased. When the resin film 5 has the through holes 11 having a cross-section the area of which is constant across the inside of the resin film 5 as shown in FIG. 2, the porosity corresponds to the open area ratio. When, as shown in FIG. 3, the resin film 5 has the through holes 11 having a cross-section the area of which increases from the first principal surface 12*a* toward the second principal surface 12*b*, the porosity can be determined, for example, by calculation based on the open area ratios in both of the principal surfaces 12*a* and 12*b* and on the shape of the through holes 11 which is confirmed by observing a cross-section of the resin film 5.

The apparent density of the resin film 5 is, for example, 0.1 g/cm$^3$ or more and 1.5 g/cm$^3$ or less and can be 0.2 g/cm$^3$ or more and 1.4 g/cm$^3$ or less. When the apparent density is within these ranges, the flexibility in the design of various properties of the mask 1 having the main body 2 including the resin film 5 is further increased. The apparent density can be determined by cutting the resin film 5 into a piece of arbitrary size and dividing the weight W (g) of the piece of the film by its volume V (cm$^3$).

As for the sound permeability, for example, a sound pressure loss (insertion loss) across the resin film 5 at a frequency of 1 kHz can be 5 dB or less. The sound pressure loss at a frequency of 1 kHz can, depending on the configuration of the resin film 5, be 3 dB or less, 2 dB or less, or even 1 dB or less. With the use of a non-woven fabric or woven fabric, such a low sound pressure loss is difficult to achieve. The frequency of 1 KHz approximately corresponds to a median in the range of frequencies that humans use in their usual vocalization and conversation.

As for the transparency, for example, a total light transmittance of the resin film 5, as measured according to JIS K 7361, can be 60% or more. The total light transmittance can, depending on the configuration of the resin film 5, be 70% or more, 80% or more, or even 90% or more.

As for the transparency, for example, a haze of the resin film 5, as measured according to JIS K 7136, can be 50% or less. The haze can, depending on the configuration of the resin film 5, be 30% or less or even 20% or less.

The thickness of the resin film 5 is, for example, 5 μm or more and 100 μm or less and preferably 15 μm or more and 50 μm or less.

In the resin film 5, a ratio t/R, may be 1 or more and 10000 or less, where R denotes the diameter of the through holes 11 and t denotes the thickness of the resin film 5. In this case, the flexibility in the design of various properties of the mask 1 having the main body 2 including the resin film 5 is further increased.

The material composing the resin film 5 is not particularly limited. The material is, for example, a material that allows the production methods described below to form the through holes 11 in an original film which is a resin film made of the material.

When the through holes 11 are formed by ion beam irradiation and chemical etching of an original film, the material composing the resin film 5 and original film is, for example, a resin degradable by an alkaline solution, an acidic solution, or an alkaline or acidic solution to which has been added at least one selected from an oxidant, an organic solvent, and a surfactant. These solutions are typical etchants. From another standpoint, the resin film 5 and original film in this case are composed of, for example, a resin that can be etched by hydrolysis or oxidative degradation. In this case, the resin film 5 and original film are composed of, for example, at least one resin selected from polyethylene terephthalate (PET), polycarbonate, polyimide, polyethylene naphthalate, and polyvinylidene fluoride.

When the through holes 11 are formed by laser irradiation of an original film, the material composing the resin film 5 and original film is, for example, a material selected from: polyolefins such as polyethylene and polypropylene; polyesters such as polyethylene terephthalate (PET), polybutylene terephthalate, and polyethylene naphthalate; fluorine resins such as polytetrafluoroethylene (PTFE); polyimide; polyamide-imide; polyetheretherketone; polysulfone; polybutadiene; epoxy resins; polystyrene; polymethyl methacrylate; polycarbonate; triacetyl cellulose; polyvinyl alcohol; polyurethane; ABS resins; ethylene-propylene-diene copolymer; and silicone rubber. In view of the ease of laser drilling, the material composing the resin film 5 and original film may include, for example, at least one resin selected from PET, polypropylene, PTFE, polyimide, polymethyl methacrylate, polycarbonate, triacetyl cellulose, polyurethane, and silicone rubber.

In view of the transparency of the mask 1 having the main body 2 including the resin film 5, the resin film 5 and original film are preferably composed of a transparent material. Specifically, the resin film 5 and original film are preferably composed of at least one resin selected from PET, polycarbonate, polyimide, polyethylene naphthalate, and polyvinylidene fluoride.

The resin film 5 may be subjected to various processes such as liquid-repellent treatment, coloring treatment, and anti-fogging treatment.

With the use of the resin film 5 subjected to liquid-repellent treatment, for example, the mask 1 can be obtained which has a higher ability to prevent penetration of droplets from outside or which further has waterproof properties. The liquid-repellent treatment can be accomplished by a known method. For example, a treatment solution prepared by diluting a water-repellent agent or hydrophobic oil-repellent agent with a diluent may be thinly spread and dried on the resin film 5. Alternatively, the resin film 5 may be immersed in the treatment solution and then dried. Examples of the water-repellent agent and hydrophobic oil-repellent agent include fluorine compounds such as perfluoroalkyl acrylate and perfluoroalkyl methacrylate. The liquid-repellent treatment can result in the formation of a liquid-repellent layer on at least a portion of the surfaces of the resin film 5. The liquid-repellent layer may be formed over the entire surfaces of the resin film 5. The liquid-repellent layer formed can have openings positioned in correspondence with the openings of the through holes 11.

With the use of the resin film 5 subjected to coloring treatment, for example, the mask 1 can be obtained which has the main body 2 at least a portion of which has a specific color. An example of the coloring is to impart a color that can keep a medical worker wearing the mask 1 from concerning about blood adhered to the mask during treatment of a patient.

With the use of the resin film 5 subjected to anti-fogging treatment, for example, the mask 1 can be obtained which resists being fogged by breathing of the wearer even when the ambient temperature is low. The anti-fogging treatment can be accomplished by a known method.

The above various treatments can be performed on the whole or a portion of the resin film 5.

[Method for Producing Resin Film]

The method for producing the resin film 5 is not particularly limited. For example, the resin film 5 can be produced by the methods described hereinafter.

In the first production method, the resin film 5 is produced by ion beam irradiation and subsequent etching (chemical etching) of an original film. The resin film 5 produced by ion beam irradiation and etching can be used per se in the mask 1. The resin film thus produced may, if necessary, be subjected to an additional step such as a liquid-repellent treatment step, a coloring treatment step, or an anti-fogging treatment step, and the resulting film may be used in the mask 1.

This method, in which the resin film 5 is produced by ion beam irradiation and subsequent chemical etching, allows easy control of various parameters of the resin film 5 such as the diameter and density of the through holes 11, the open area ratio, the porosity, and the air permeability.

The original film can be a non-porous resin film having no passage that allows through-thickness air permeation in a region that is to be used as the resin film 5 after ion beam irradiation and chemical etching. The original film may be an imperforate film.

The original film may be subjected to coloring treatment as described above. In this case, the resin film 5 is produced as a colored film.

When the original film is irradiated with an ion beam, the polymer chains constituting the resin film are bombarded with and damaged by ions in those portions of the film through which the ions pass. The damaged polymer chains are more susceptible to chemical etching than the other polymer chains not bombarded with the ions. Chemical etching of the ion beam-irradiated original film thus results in a resin film having minute holes (through holes) extending along the tracks of the bombarding ions. That is, the directions of the central axes 13 of the through holes 11 coincide with the directions in which the ions have passed through the original film during the ion beam irradiation. In general, no minute holes are formed in those portions of the original film through which no ions have passed.

This method for producing the resin film 5 from an original film may include the steps of: (I) irradiating a non-porous original film with an ion beam; and (II) chemically etching the ion beam-irradiated original film. In the step (I), the tracks of bombarding ions (ion tracks) are formed in the original film so as to extend straight through the thickness of the film. In the step (II), the through holes 11 corresponding to the ion tracks formed in the step (I) are formed in the original film by chemical etching to produce the resin film 5 having air permeability through the thickness thereof.

This method is capable of producing the resin film 5 as shown in FIG. 2 which has the through holes 11 having a cross-section the area of which is constant from the first principal surface 12*a* to the second principal surface 12*b*, and is also capable of producing the resin film 5 having the through holes 11 in which the cross-sectional area increases from the first principal surface 12*a* toward the second principal surface 12*b*. The resin film 5 of the former kind can be produced, for example, by chemically etching the ion-irradiated original film directly. The etching removes the portions corresponding to the ion tracks formed in the original film. Thus, the through holes 11 whose cross-section has a constant area are formed by allowing the chemical etching to proceed over a sufficiently long time.

The resin film 5 of the latter kind can be produced, for example, by carrying out the chemical etching in the step (II) in such a manner that the extent of etching of the ion-bombarded portions from one principal surface is greater than the extent of etching of the ion-bombarded portions from the other principal surface. Specifically, for example, the resin film can be produced by performing the chemical etching with a masking layer placed on one principal surface of the ion-irradiated original film. In this chemical etching, the extent of etching from the other principal surface is greater than the extent of etching from the one principal surface with the masking layer placed thereon. Such non-uniform etching, in particular etching in which the rate of etching from one principal surface of the ion-irradiated original film and the rate of etching from the other principal surface are different, is capable of forming the through holes 11 having a shape in which the area of the cross-section changes from one principal surface of the resin film 5 toward the other principal surface of the resin film 5. In the etching process for producing the resin film 5 of the former kind without the use of a masking layer, the etching of the ion beam-irradiated original film progresses uniformly from both principal surfaces of the original film.

Hereinafter, the steps (I) and (II) in the first production method will be described in more detail.

[Step (I)]

In the step (I), an original film is irradiated with an ion beam. The ion beam is composed of accelerated ions. The irradiation with an ion beam causes the original film to be bombarded with the ions in the beam.

Figure 9:
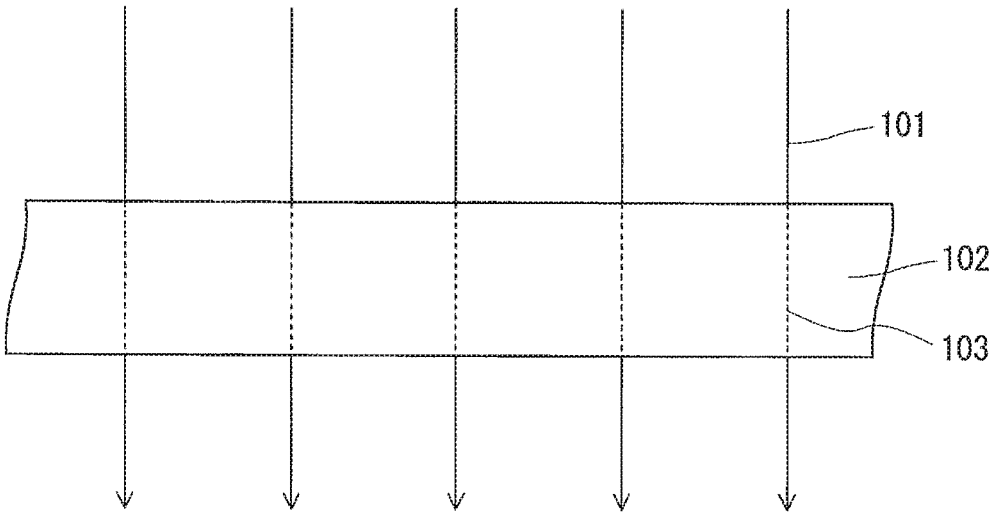
FIG. 9 is a schematic diagram for illustrating the overview of ion beam irradiation in a method for producing a resin film usable in the main body of the mask according to the present invention by employing the ion beam irradiation and subsequent chemical etching.

FIG. 9 illustrates irradiation of an original film with an ion beam. Ions 101 in the beam collide with an original film 102, and the ions 101 having collided with the film 102 leave tracks (ion tracks) 103 within the film 102. When viewed on the size scale of the original film 102 to be irradiated, the ions 101 impinge on the original film 102 typically along a substantially straight line, thus forming the tracks 103 extending substantially straight in the film 102. In general, the ions 101 penetrate through the original film 102.

The method for irradiating the original film 102 with the ion beam is not limited. For example, the original film 102 is placed in a chamber, the internal pressure of the chamber is reduced (for example, a high vacuum atmosphere is created in the chamber to prevent energy attenuation of the bombarding ions 101), and then the ions 101 are emitted from a beamline to irradiate the original film 102. A particular gas may be introduced into the chamber. Alternatively, ion beam irradiation of the original film 102 placed in the chamber may be carried out without reduction in the internal pressure of the chamber; for example, the ion beam irradiation may be carried out at atmospheric pressure.

It is also conceivable to prepare a roll on which the original film 102 in the form of a strip is wound and continuously irradiate the original film 102 with the ion beam while feeding the original film 102 from the roll. This allows efficient production of the resin film 5. It is also conceivable to dispose the roll (feed roll) and a take-up roll for winding up the ion beam-irradiated original film 102 in the chamber described above, create an appropriate atmosphere such as a reduced-pressure or high vacuum atmosphere in the chamber, then continuously irradiate the original film 102 in the form of a strip with the ion beam while feeding the film from the feed roll, and then wind the beam-irradiated original film 102 on the take-up roll.

The resin composing the original film 102 is identical to the resin composing the resin film 5.

The original film 102 to be irradiated with the ion beam is, for example, an imperforate film. In this case, the resin film 5 having no holes other than the through holes 11 formed by the steps (I) and (II) can be produced unless an additional step of forming holes in the film is performed in addition to the steps (I) and (II). When the additional step is performed, the resulting resin film 5 has the through holes 11 formed by the steps (I) and (II) and holes formed by the additional step.

The type of the ions 101 with which the original film 102 is irradiated and bombarded is not limited. It is preferable for the ions to include ions having a larger mass number than neon, specifically at least one species selected from argon ions, krypton ions, and xenon ions, since these ions do not readily chemically react with the resin composing the original film 102.

The energy (acceleration energy) of the ions 101 is typically 100 to 1000 MeV. When the original film 102 used is a polyester film having a thickness of about 5 to 100 μm and the ions 101 are argon ions, the energy of the ions 101 is preferably 100 to 600 MeV. The energy of the ions 101 to be applied to the original film 102 can be adjusted depending on the type of the ions and on the type of the resin composing the original film 102.

The ion source of the ions 101 to be applied to the original film 102 is not limited. For example, the ions 101 emitted from the ion source are accelerated by an ion accelerator, then passed through a beamline, and applied to the original film 102. The ion accelerator is, for example, a cyclotron, a specific example of which is an AVF cyclotron.

The pressure in the beamline serving as a path of the ions 101 is preferably a high vacuum pressure of about $10^{-5}$ to $10^{-3}$ Pa, in terms of preventing the energy attenuation of the ions 101 in the beamline. When the pressure in the chamber enclosing the original film 102 to be irradiated with the ions 101 does not reach a high vacuum pressure, a partition permeable to the ions 101 may be used to maintain the pressure difference between the beamline and the chamber. The partition is made up of, for example, a titanium membrane or aluminum membrane.

The ions 101 are applied to the original film 102, for example, in a direction perpendicular to the principal surfaces of the film. The irradiation in the example shown in FIG. 9 is performed in this manner. In this case, the tracks 103 extend perpendicular to the principal surfaces of the original film 102; thus, the subsequent chemical etching results in the resin film 5 having through holes 11 formed to extend in the direction perpendicular to the principal surfaces of the resin film 5.

The ions 101 may be applied to the original film 102 in a direction oblique to the principal surfaces of the film. In this case, the subsequent chemical etching results in the resin film 5 having through holes 11 formed to extend in a direction oblique to the direction perpendicular to the principal surfaces of the resin film 5. The direction of the ions 101 applied to the original film 102 can be controlled by known means. The angle θ1 shown in FIG. 4 can be controlled, for example, by adjusting the incident angle of the ion beam to the original film 102.

The ions 101 are applied to the original film 102, for example, in such a manner that the trajectories of the ions 101 are parallel to each other. The irradiation in the example shown in FIG. 9 is performed in this manner. In this case, the subsequent chemical etching results in the resin film 5 having through holes 11 formed to extend parallel to each other.

The ions 101 may be applied to the original film 102 in such a manner that the trajectories of the ions 101 are non-parallel to each other (random with respect to each other, for example). This results in, for example, the resin film 5 as shown in any of FIGS. 4 to 7. Specifically, for example, a possible method for producing the resin film 5 as shown in any of FIGS. 4 to 7 is to apply the ion beam to the original film 102 in a direction oblique to the direction perpendicular to the principal surfaces of the original film 102 while changing the oblique direction continuously or stepwise. Since the ion beam is composed of ions traveling parallel to each other, the resin film 5 typically has a set of through holes 11 extending in the same direction (there are typically two or more through holes 11 extending in the same direction in the resin film 5).

Figure 10:
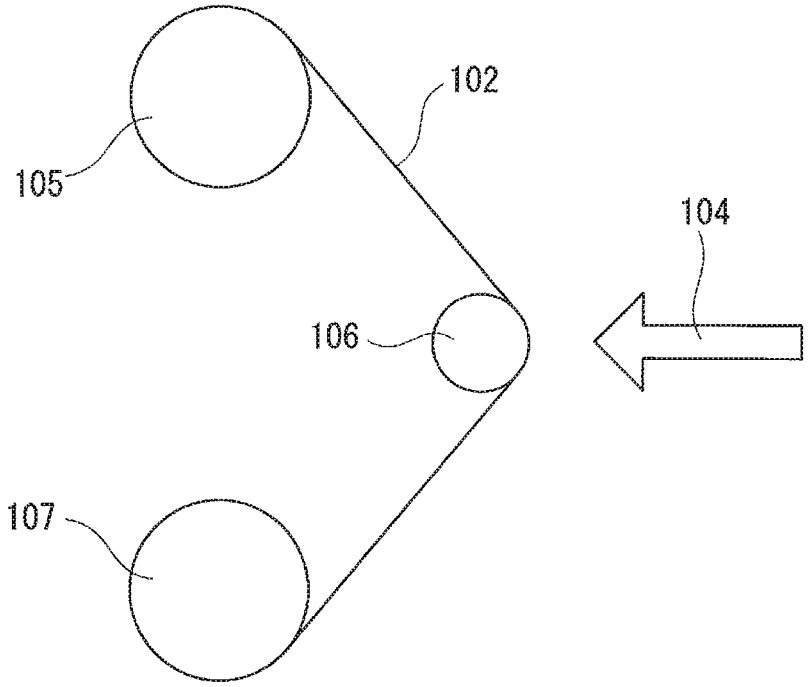
FIG. 10 is a schematic diagram for illustrating an example of ion beam irradiation in a method for producing a resin film usable in the main body of the mask according to the present invention by employing the ion beam irradiation and subsequent chemical etching.

FIG. 10 shows an example of the method in which the oblique direction is changed continuously or stepwise. In the example shown in FIG. 10, the original film 102 in the form of a strip is fed from a feed roll 105, passed through an irradiation roll 106 with a predetermined curvature, and irradiated with an ion beam 104 while moving on the roll 106, after which the irradiated original film 102 is wound on a take-up roll 107. During this process, the ions 101 in the ion beam 104 travel parallel to each other and reach the original film 102 successively. Thus, the angle (incident angle θ1) at which the ion beam impinges on the principal surface of the original film 102 varies with the movement of the original film 102 on the irradiation roll 106. Continuous emission of the ion beam 104 allows continuous change of the oblique direction, while intermittent emission of the ion beam 104 allows stepwise change of the oblique direction. Such control can be considered to be based on ion beam emission timing. The properties (for example, angle θ1) of the tracks 103 to be formed in the original film 102 can be controlled also by adjusting the cross-sectional shape of the ion beam 104 and the cross-sectional area of the beamline of the ion beam 104 formed on the irradiation target surface of the original film 102.

The hole density of the resin film 5 can be controlled by the conditions of the irradiation of the original film 102 with the ion beam (such as the type of the ions, the energy of the ions, and the density of the bombarding ions (irradiation density)).

The ions 101 may be emitted from two or more beamlines to irradiate the original film 102.

The step (I) may be performed in the presence of a masking layer on a principal surface, such as the one principal surface as described above, of the original film 102. In this case, for example, the masking layer can be used also in the step (II).

[Step (II)]

The original film 102 irradiated with the ion beam in the step (I) has portions bombarded with the ions 101 and, in the step (II), the ion-bombarded portions are chemically etched to form through holes 11 extending along the tracks 103 of the bombarding ions 101 in the film. The resin film 5 thus obtained is basically identical to the original film 102 that has yet to be subjected to the ion beam irradiation except for the presence of the through holes 11, unless another step of modifying the nature of the film is performed.

The specific technique employed for the etching may be the same as any of known techniques. For example, the ion beam-irradiated original film 102 may be immersed in an etchant at a predetermined temperature for a predetermined time. Adjusting the etching conditions such as the etching temperature, the etching time, and the composition of the etchant allows, for example, control of the diameter of the through holes 11.

The etching temperature is, for example, 40 to 150° C., and the etching time is, for example, 10 seconds to 60 minutes.

The etchant used in the chemical etching is not particularly limited. The etchant is, for example, an alkaline solution, an acidic solution, or an alkaline or acidic solution to which has been added at least one selected from an oxidant, an organic solvent, and a surfactant. The alkaline solution is, for example, a solution (typically an aqueous solution) containing a base such as sodium hydroxide or potassium hydroxide. The acidic solution is, for example, a solution (typically an aqueous solution) containing an acid such as nitric acid or sulfuric acid. The oxidant is, for example, potassium dichromate, potassium permanganate, or sodium hypochlorite. The organic solvent is, for example, methanol, ethanol, 2-propanol, ethylene glycol, amino alcohol, N-methylpyrrolidone, or N,N-dimethylformamide. The surfactant is, for example, an alkyl benzenesulfonic acid salt or an alkyl sulfuric acid salt.

In the step (II), the chemical etching may be performed in the presence of a masking layer on one principal surface of the ion beam-irradiated original film 102. In this chemical etching of those portions of the original film 102 which have been bombarded with the ions 101, the extent of etching from the other principal surface is greater than the extent of etching from the one principal surface with the masking layer thereon. That is, the chemical etching of those portions of the original film 102 which have been bombarded with the ions 101 is performed in such a manner that the etching from one principal surface of the film and the etching from the other principal surface of the film progress in a non-uniform fashion (such etching may be referred to as "non-uniform etching"). Saying that "the extent of etching is great" specifically means, for example, that the amount of etching of the ion-bombarded portions per unit time is large, namely, that the rate of etching of the portions is high.

In the step (II), a masking layer more resistant to chemical etching than those portions of the original film 102 which have been bombarded with the ions 101 may be placed on one principal surface of the original film 102 to perform chemical etching in which the etching of the portions from the other principal surface of the original film 102 is allowed to progress while the etching of the portions from the one principal surface is inhibited. Such etching can be accomplished, for example, by appropriately selecting the type and thickness of the masking layer, the manner of the placement of the masking layer, and the etching conditions.

The type of the masking layer is not particularly limited. The masking layer is preferably composed of a material more resistant to chemical etching than those portions of the original film 102 which have been bombarded with the ions 101. Saying that a material is "resistant to etching" specifically means, for example, that the amount of the material etched per unit time is small, namely, that the rate at which the material is etched is low. Whether a material is resistant to chemical etching can be determined on the basis of the conditions (such as the type of the etchant, the etching temperature, and the etching time) of the non-uniform etching to be actually performed in the step (II). When, in the step (II), non-uniform etching is performed a plurality of times by changing the type of the masking layer and/or alternating the surface on which the layer is placed, whether a material is resistant to chemical etching can be determined for each etching on the basis of the etching conditions.

The masking layer may be more susceptible or more resistant to chemical etching than those portions of the original film 102 which have not been bombarded with the ions 101. The masking layer is preferably more resistant to chemical etching than such portions. In this case, for example, the thickness required of the masking layer used in the non-uniform etching can be decreased.

When the original film 102 with a masking layer thereon is irradiated with the ion beam in the step (I), ion tracks are formed also in the masking layer. Given this, the material composing the masking layer is preferably a material having polymer chains resistant to damage by ion beam irradiation.

The masking layer is composed of, for example, at least one selected from polyolefin, polystyrene, polyvinyl chloride, polyvinyl alcohol, and a metal foil. These materials are resistant to chemical etching as well as being resistant to damage by ion beam irradiation.

When a masking layer is used to perform non-uniform etching, the masking layer can be placed on at least a portion of one principal surface of the original film 102, the portion corresponding to the area to be subjected to the non-uniform etching. The masking layer can, if necessary, be placed over the entirety of one principal surface of the original film 102.

The method for placing the masking layer on a principal surface of the original film 102 is not limited as long as the masking layer is not separated from the principal surface during the non-uniform etching. The masking layer is placed on the principal surface of the original film 102, for example, by means of an adhesive. That is, in the step (II), the chemical etching (non-uniform etching) may be performed in the presence of a masking layer bonded to the one principal surface of the original film 102 by means of an adhesive. It is relatively easy to dispose the masking layer by means of an adhesive. Appropriately selecting the type of the adhesive makes it easy to separate the masking layer from the original film 102 after the non-uniform etching.

When the non-uniform etching is performed in the step (II), the non-uniform etching may be performed a plurality of times. Uniform etching in which etching of the tracks 103 is allowed to progress uniformly from both principal surfaces of the original film 102 may be performed in combination with the non-uniform etching. For example, the masking layer may be separated from the original film 102 in the course of the etching to switch the mode of etching from the non-uniform etching to the uniform etching. Alternatively, the masking layer may be placed on the original film 102 after the end of the uniform etching to subsequently perform the non-uniform etching.

When the non-uniform etching employing a masking layer is performed in the step (II), a part or the whole of the masking layer may, if necessary, be allowed to remain on the resin film 5 after the etching. The masking layer remaining on the resin film 5 can be used, for example, as an indicator for differentiating between the one principal surface (the principal surface with the masking layer thereon) of the resin film 5 and the other principal surface of the resin film 5.

When etching is performed a plurality of times in the step (II), the etching conditions may be changed for each time of etching.

The first production method may include any step other than the steps (I) and (II).

In the second production method, the resin film 5 is produced by irradiating an original film with a laser to form through holes 11 in the original film. The resin film 5 having the through holes 11 formed by laser irradiation may be used per se in the mask 1. The resin film thus produced may, if necessary, be subjected to an additional step such as a liquid-repellent treatment step, a coloring treatment step, or an anti-fogging treatment step, and the resulting film may be used in the mask 1.

This method, in which the resin film 5 is produced by laser irradiation, allows easy control of various parameters of the resin film 5 such as the diameter and density of the through holes 11, the open area ratio, the porosity, and the air permeability.

The original film can be a non-porous resin film having no passage that allows through-thickness air permeation in a region that is to be used as the resin film 5. The original film may be an imperforate film.

A material identical to the material composing the resin film 5 to be obtained can be selected as the material composing the original film.

Typically, the laser irradiation for forming the through holes 11 causes no change in film thickness. Thus, the desired thickness of the resin film 5 to be obtained can be achieved by selecting the thickness of the original film.

The original film is irradiated, for example, with a focused pulsed laser. For the focused pulsed laser irradiation, a known laser and a known optical system can be used. The laser is, for example, a UV pulsed laser, and the wavelength of the laser is, for example, 355 nm, 349 nm, or 266 nm (corresponding to the wavelength of high-order harmonics of a solid-state laser using Nd:YAG, Nd:YLF, or $YVO_4$ as a medium) or is 351 nm, 248 nm, 222 nm, 193 nm, or 157 nm (corresponding to the wavelength of an excimer laser). A laser emitting light with a wavelength outside the UV range may be used, as long as the through holes 11 can be formed in the original film. The pulse width of the laser is not limited either as long as the through holes 11 can be formed. For example, a pulsed laser with a pulse width on the order of femtoseconds or picoseconds can be used. With the use of such a pulsed laser, the through holes 11 are formed by ablation due to multiphoton absorption. The spatial intensity distribution of the laser beam may be a Gaussian distribution in which the central intensity is high or may be a top-hat distribution in which the intensity is uniform.

The optical system includes, for example, a galvano scanner and a Fθ lens (condensing lens). The Fθ lens is preferably selected and placed in the optical system so that the telecentricity is within 5 degrees. The optical system can include a polygon mirror scanner. The use of the optical system including these scanners makes it easier to form the through holes 11 at the desired positions in the original film.

In the laser irradiation of the original film, a measure may be taken to prevent matter produced by decomposition of the original film from adhering to the optical system and/or the film. Examples of the preventive measure include: blowing an assist gas onto the portion to be processed or onto the vicinity of the portion; and applying suction to the portion to be processed or on the vicinity of the portion. As the assist gas there can be used, for example, an inert gas such as nitrogen, air, or oxygen. The gas blowing and the suction application may be carried out together.

In view of the ease of formation of the through holes 11 by laser irradiation, the thickness of the original film is preferably 5 μm or more and 50 μm or less. When the thickness of the original film is within this range, the formation of the through holes 11 by laser irradiation can be accomplished more efficiently.

The laser irradiation of the original film may be carried out as follows: the original film cut into a given size is irradiated with a laser, with the original film being fixed or with the original film being moved; or the original film prepared in the form of a strip is irradiated with a laser, with the original film being moved. It is also conceivable to wind the original film in the form of a strip onto a roll, feed the original film from the roll, irradiating the moving original film in the form of a strip with a laser, and wind the laser-irradiated film on another roll. That is, the laser irradiation of the original film in the form of a strip may be performed by a roll-to-roll process.

In view of efficient removal of laser irradiation-produced decomposition residue of the material composing the original film, the laser irradiation of the original film may be carried out in such a manner that the original film held in midair is irradiated with a laser. In this case, a suction mechanism for efficiently collecting and removing decomposed matter may, if desired, be placed facing the back surface (the surface opposite to that surface to be irradiated with a laser) of the original film.

During the laser irradiation of the original film, a certain tension is preferably applied to that portion of the original film which is to be irradiated with a laser. By so doing, the occurrence of defects caused by wrinkling or slacking of the original film during the laser irradiation can be reduced.

After the formation of the through holes 11 by the laser irradiation of the original film, the laser-irradiated film may, if necessary, be cleaned to remove matter adhering to the film, such as decomposition residue of the material composing the original film. The method for cleaning is not limited, and can be selected, for example, from wet cleaning by water immersion, showering, and/or ultrasonication and dry cleaning using a plasma, UV ozone, ultrasonic wave, brush, and/or adhesive tape. When the wet cleaning is employed, a drying step may be added if necessary.

The original film may be subjected to coloring treatment as described above. In this case, the resin film 5 is produced as a colored film.

The original film may be subjected to liquid-repellent treatment as described above. In this case, the resin film 5 can be produced as a liquid-repellent film.

The second production method may include any step other than the steps described above.

[Mask]

The configuration of the mask according to the present invention is not limited as long as the mask has a main body that covers at least a portion of the face of the wearer, typically the nostrils and mouth of the wearer, and that includes the resin film 5. The mask according to the present invention can have the same configuration as known masks, except that the main body includes the resin film 5. For example, the mask according to the present invention can, like the mask 1 shown in FIG. 1, include an engaging portion 3 for holding a main body 2 including the resin film 5 in position on the face of the wearer.

The main body may consist only of the resin film 5 or may be composed of the resin film 5 and another member. Preferably, the portion of the main body that covers at least the mouth, desirably the nostrils and mouth, of the wearer 51 is composed of the resin film 5 in order to more reliably ensure breathing of the wearer 51 and allow easy transmission of utterances of the wearer to the outside of the mask (improve the sound permeability of the mask 1), namely in order to achieve high levels of shielding ability, air permeability, and sound permeability. When the resin film 5 has transparency, the portion of the main body 2 that needs to be transparent may be composed of the resin film 5, or the entire main body 2 may be composed of the resin film having transparency.

The main body 2 is shaped to cover at least a portion of the face of the wearer of the mask 1, typically the nostrils and mouth of the wearer. Given that the mask 1 according to the present invention can, for example, exhibit high shielding ability, high air permeability, high transparency, and high sound permeability, the main body 2 may be shaped to cover the entire face of the wearer of the mask 1. The main body 2 may be transparent and shaped to cover the entire face of the wearer, and the portion of the main body 2 that covers a portion of the face of the wearer, typically the nostrils and mouth of the wearer, may be composed of the resin film 5.

The main body 2 may be shaped to have pleats that are unfolded when the wearer properly wears the mask 1. The main body 2 may be in the shape of a flat sheet or curved sheet. The hardness of the main body 2 can be varied depending on the selection of the material, thickness etc. of the resin film 5 and/or the portion of the main body 2 other than the resin film 5; the main body 2 can be so soft as to conform to the shape of the face of the wearer 1 or can be so rigid as to remain unchanged in shape when the mask 1 is worn.

The whole or a portion of the main body 2, including the resin film 5, may be colorless and transparent or may be colored. A colored and transparent material or a colored and opaque material may be used in the resin film 5 and/or the portion of the main body 2 other than the resin film 5. For example, a polyimide film is typically transparent and colored (orange).

As described above, the high flexibility in the design of various properties such as shielding ability, air permeability, transparency, and sound permeability allows the features (such as shape, structure, and hardness) of the main body 2 and the mask 1 including the main body 2 to be widely varied.

The following describes exemplary variants other than those described above.

The whole or a portion of the main body 2, including the resin film 5, may be subjected to processes such as liquid-repellent treatment, anti-fogging treatment, and printing. The liquid-repellent treatment and the anti-fogging treatment are as described above for the resin film 5. The manner and method of printing are not limited to specific ones. Printing can be more freely performed on the main body 2 than on a main body composed of a non-woven fabric or woven fabric. For example, when the mask is used for medical purposes, improvement in communication between medical workers and patients can be achieved not only by exploiting the transparency of the main body 2, but also by printing an animal face aimed at pediatric patients on the main body 2. Other various types of printing can be performed on the main body 2 including the resin film 5, and examples include: printing of a member for determining whether the mask 1 has been used; printing of a member for checking the mask 1 for contamination; printing of a serial number, an ID number, the name of a department to which the owner of the mask belongs, or the name of the owner; printing of an electronic element such as an IC chip or GPS chip; and printing of an electronic circuit of an electronic part such as an antenna, microphone, or earphone.

The mask 1 may be disposable or reusable.

The mask 1 can have a member other than the main body 2. An example of the member is the engaging portion 3 for holding the main body 2 in position on the face of the wearer. The configuration of the engaging portion 3 is not limited, and may be the same as that of engaging portions of known masks. The engaging portion 3 in the example shown in FIG. 1 is a string-shaped member looped around the ear of the wearer. The engaging portion 3 can be, for example, a tape, wire, or ribbon that holds the main body 2 in position on the nose of the wearer. The method for joining the engaging portion 3 to the main body 2 is not limited. The position of the engaging portion 3 in the mask 1 and the position where the engaging portion 3 and the main body 2 are joined are not limited either.

EXAMPLES

Hereinafter, the present invention will be described in more detail with examples. The present invention is not limited to the examples presented below.

First, methods employed to evaluate resin films 5 produced in Examples and various conventional masks used in Comparative Examples will be described.

[Air Permeability]

The air permeability (through-thickness air permeability) of the resin films 5 and the main bodies of the conventional masks was determined by Frazier air permeability testing according to JIS L 1096. In the measurement of the air permeability, the resin films 5 and the main bodies of the conventional masks were cut into 100 mm×100 mm pieces, which were used as measurement samples.

[Transparency]

To evaluate the level of transparency of the resin films 5 and the main bodies of the conventional masks, the total light transmittance was measured according to JIS K 7361-1, and the haze (cloudiness) was measured using a haze meter (NDH 7000, manufactured by NIPPON DENSHOKU INDUSTRIES CO., LTD.) according to JIS K 7136.

[Sound Permeability (Sound Pressure Loss)]

The sound permeability of the resin films 5 and the main bodies of the conventional masks was evaluated as follows.

Figure 11:
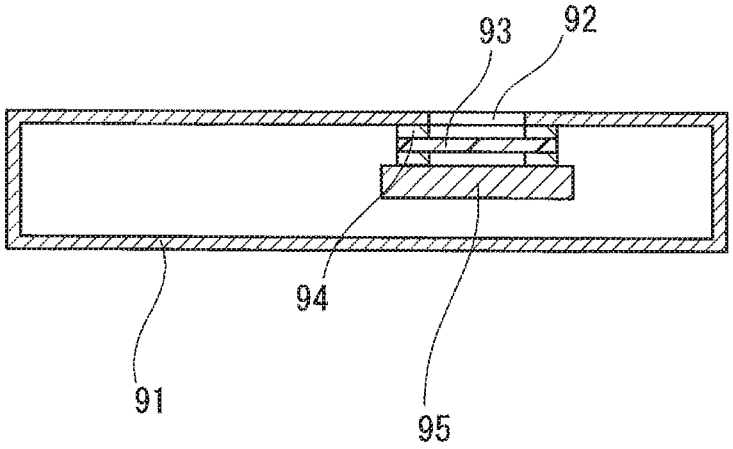
FIG. 11 is a cross-sectional view schematically showing: a simulated housing used in examples for evaluation of sound pressure loss (insertion loss) across the material composing the main body of the mask; and how a measurement sample and a speaker are fixedly placed in the housing.

First, as shown in FIG. 11, a case 91 having a rectangular parallelepiped shape and having a hollow interior (made of acrylic resin and having a length of 70 mm, a width of 50 mm, and a height of 15 mm) was prepared. The case 91 has in its top surface one opening 92 of 13 mm diameter and has no opening other than the opening 92. Additionally, the resin films 5 and the main bodies of the conventional masks, which were to be evaluated, were punched to prepare measurement samples in the shape of a circle of 16 mm diameter.

Next, the measurement sample 93 was attached to the inner surface of the case 91 with a ring-shaped double-coated adhesive tape 94 having an outer diameter of 16 mm and an inner diameter of 13 mm so as to fully cover the opening 92. The attachment of the measurement sample 93 to the case 91 was done in such a manner that the double-coated adhesive tape 94 did not protrude below the opening 92 and that any gap was not formed between the inner surface of the case 91 and the measurement sample 93. Next, a speaker 95 was attached to the measurement sample 93 using the same double-coated adhesive tape as above. This attachment was also done in such a manner that any gap was not formed between the measurement sample 93 and the speaker 95. The speaker used was SCG-16 A manufactured by STAR MICRONICS CO., LTD.

Next, a microphone (Type 2669, manufactured by B&K Sound & Vibration Measurement A/S) connected to an acoustic evaluation system (Multi-analyzer System 3560-B-030, manufactured by B&K Sound & Vibration Measurement A/S) was placed outside the case 91 at a distance of 50 mm from the speaker 95. Subsequently, SSR analysis (test signals of 20 Hz to 20 kHz, sweep up) was selected as an evaluation mode and carried out to evaluate the acoustic characteristics (THD and sound pressure loss) of the measurement sample 93. The sound pressure loss was automatically determined on the basis of the signal input to the speaker 95 from the acoustic evaluation system and the signal detected through the microphone. Additionally, a blank sound pressure loss was determined in the same manner except that the measurement sample 93 was not placed over the opening 92, and a value obtained by subtracting the blank sound pressure loss from the sound pressure loss determined in the presence of the measurement sample 93 was determined as the sound pressure loss (insertion loss) used as an index of the quality of the sample. A smaller insertion loss can be considered to indicate better maintenance of the characteristics of sound transmitted through the measurement sample 93. In the present examples, the sound permeability of the measurement samples was evaluated by a sound pressure loss at a frequency of 1 kHz.

[Shielding Ability]

The shielding ability of the resin film 5 produced in Example 1 and the conventional mask used in Comparative Example 1 was evaluated on the basis of a pollen permeability measured by pollen permeability testing according to Boken Quality Evaluation (BQE) A 030. The details of the evaluation were as follows. First, a glass filter and black filter paper impervious to pollen were set on a cylindrical glass holder (inner diameter=about 2 cm) that allows suction from below, and each of the measurement samples was individually placed on the black filter paper. The measurement samples were obtained by cutting the resin film 5 and the main body of the conventional mask into pieces having a shape and size adapted for placement within the holder (circular pieces with a diameter of about 2 cm). Next, 0.05 g of cedar pollen was spread uniformly over the measurement sample, and a suction pump connected to the lower portion of the holder was used to apply suction at a rate of 12 L/min (corresponding to average respiratory airflow in breathing of humans at rest) for 1 minute. During the application of suction, air passes sequentially through the pollen, the measurement sample, the black filter paper, and then the glass filter, and thus the pollen permeating the measurement sample is collected by the filter paper. The weight WA of the filter paper before the application of suction and the weight WB of the filter paper after the application of suction were measured, and the pollen permeability was determined by the following equation: [Pollen permeability (%)]=[(WB−WA)/0.05 g]×100.

Example 1

As the resin film 5 there was prepared a non-porous PET film (Oxydisk, manufactured by Oxyphen AG) having through holes extending through the thickness of the film. This film is one produced by subjecting an imperforate original film made of PET to ion beam irradiation and chemical etching to form through holes extending in a direction perpendicular to the principal surfaces of the film. The diameter of the through holes was 10 μm, the density of the through holes was 500000 ($5\times10^5$) holes/cm$^2$, the open area ratio and porosity were 31.4%, and the thickness was 41 μm.

Figure 12:
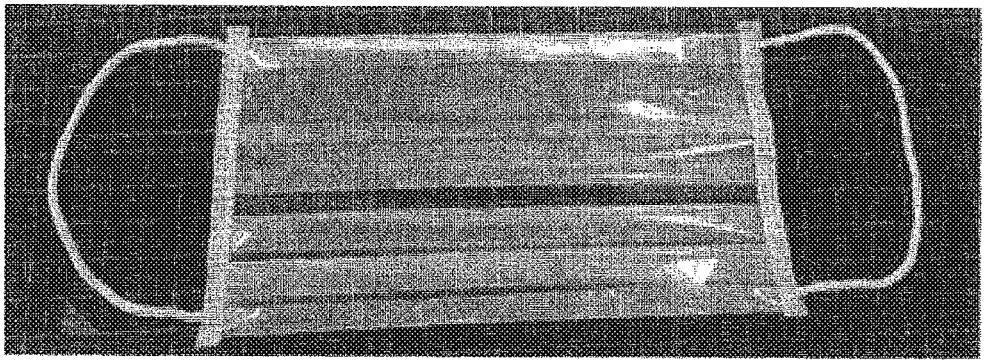
FIG. 12 shows a mask produced in Example 1.

Next, the resin film 5 prepared was cut into a 180 mm×160 mm rectangular piece, which was pleated into a 80 mm×160 mm rectangular piece. A string-shaped member to be looped around the ear of the wearer was fixed as an engaging portion to each of the two short sides of the rectangular piece by means of a double-coated adhesive tape. In this manner, a mask 1 as shown in FIG. 12 was obtained. The mask 1 produced, like conventional masks made of non-woven fabric (such as the mask used in Comparative Example 1), was able to be worn to cover the nostrils and mouth of the face of the wearer.

Example 2

As the resin film 5 there was prepared a film which was the same as the resin film 5 prepared in Example 1 except that the diameter of the through holes was 5 μm, the density of the through holes was 400000 ($4\times10^5$) holes/$cm^2$, the open area ratio and porosity were 7.9%, and the thickness was 21 μm. The prepared resin film was used to produce a mask 1 in the same manner as in Example 1. The mask 1 produced, like conventional masks made of non-woven fabric (such as the mask used in Comparative Example 1), was able to be worn to cover the nostrils and mouth of the face of the wearer.

Example 3

As the resin film 5 there was prepared a film which was the same as the resin film 5 prepared in Example 1 except that the diameter of the through holes was 2 μm, the density of the through holes was 10000000 ($1\times10^7$) holes/$cm^2$, the open area ratio and porosity were 39.2%, and the thickness was 21 μm. The prepared resin film was used to produce a mask 1 in the same manner as in Example 1. The mask 1 produced, like conventional masks made of non-woven fabric (such as the mask used in Comparative Example 1), was able to be worn to cover the nostrils and mouth of the face of the wearer Example 4

As the resin film 5 there was prepared a non-porous PET film as used in Example 1.

Additionally, a treatment solution for use in liquid-repellent treatment of the prepared resin film 5 was prepared by diluting water- and oil-repellent agent (X-70-041, MANUFACTURED BY SHIN-ETSU CHEMICAL CO., LTD.) WITH A DILUENT (ASAHIKLIN AE-3000, MANUFACTURED BY ASAHI GLASS CO., LTD.) TO A CONCENTRATION OF 1.0 wt %. The water- and oil-repellent agent contains as a component a polymer having a unit derived from a monomer having a linear fluoroalkyl group and represented by the following formula (a-1).

$$CH_2{=}CHCOOCH_2CH_2C_5F_{10}CH_2C_4F_9 \quad \text{(a-1)}$$

Next, the prepared resin film 5 was immersed in the water- and oil-repellent agent maintained at 20° C. for 3 seconds, and then left to dry at ordinary temperature for 1 hour to obtain a liquid-repellent resin film 5. Next, the resin film 5 thus obtained was used to produce a mask 1 in the same manner as in Example 1. The mask 1 produced, like conventional masks made of non-woven fabric (such as the mask used in Comparative Example 1), was able to be worn to cover the nostrils and mouth of the face of the wearer Comparative Example 1

As a mask of Comparative Example 1 there was prepared a mask (FG-195Ω, manufactured by TOKYO MEDICAL CO., LTD.) having a main body composed of a non-woven fabric.

Comparative Example 2

As a mask of Comparative Example 2 there was prepared a mask (V-Flex Particulate Respirator 9102J-DS1, manufactured by 3M Company) having a main body composed of a non-woven fabric.

Comparative Example 3

As a mask of Comparative Example 3 there was prepared a mask (Smile Catch Mask, manufactured by MIDORI ANZEN CO., LTD.) having a main body composed of an imperforate transparent film.

The results of evaluation in Examples 1 to 3 and Comparative Examples 1 to 3 are shown in Table 1 below. For the results of shielding ability evaluation in Example 1 and Comparative Example 1, the extent of deposition of pollen on the surface of the black filter paper used in the testing is shown in FIG. 13.

TABLE 1

| | Frazier air permeability ($cm^3$/($cm^2$ · sec) | Insertion loss (dB) | Total light trans-mittance (%) | Haze (%) | Pollen permeability (%) |
|---|---|---|---|---|---|
| Example 1 | 50 | 0 | 89 | 26 | 0.2 |
| Example 2 | 10 | 0.1 | 87 | 19 | — |
| Example 3 | 0.5 | 5.8 | 65 | 97 | — |
| Example 4 | 4.7 | 0.1 | 92 | 30 | — |
| Comparative Example 1 | 225 | 0 | 73 | 94 | 66.3 |
| Comparative Example 2 | 15.8 | 0 | 19 | 100 | — |
| Comparative Example 3 | 0 | 10.5 | 91 | 2 | — |

Figure 13:
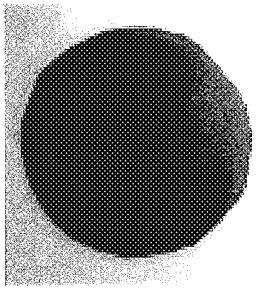
FIG. 13 shows results of testing performed for shielding ability evaluation in examples.
Figure 13:
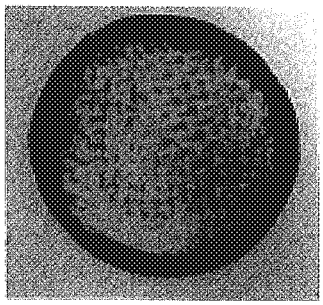

As seen from Table 1 and FIG. 13, it was confirmed in Examples that the flexibility in the design of air permeability, sound permeability, transparency, and shielding ability is high and that masks having high levels of all of these properties can be obtained. Specifically, the mask produced in Example 1 has a high air permeability which allows the wearer to easily breathe, and also has a high total light transmittance and low haze which allow the face of the wearer to be well recognized. The mask of Example 1 has an insertion loss of 0 dB and exhibits high sound permeability without altering the voice of the wearer. The mask of Example 1 is superior also in the shielding ability against pollen. As demonstrated by the masks of Examples 2 and 3, it was confirmed that the properties of the masks can be variously altered depending on, for example, the diameter of the through holes and the density of the through holes. As demonstrated in Example 4, a liquid-repellent mask was also successfully produced. When water droplets were placed on the main body of the liquid-repellent mask, the water droplets were repelled by the surface of the main body and flowed downwardly without penetrating into the mask. By contrast, the mask of Comparative Example 1, although having a very high air permeability, is inferior in the shielding ability and has a high haze which makes difficult recognition of the face of the wearer. The same is true of the mask of Comparative Example 2. It can be seen that the mask of Comparative Example 3, although having a low haze and high transparency, has a very large insertion loss and low sound permeability.

The present invention may be embodied in other forms without departing from the spirit or essential characteristics thereof. The embodiments disclosed in this specification are to be considered in all respects as illustrative and not limiting. The scope of the present invention is indicated by the appended claims rather than by the foregoing description, and all changes which come within the meaning and range of equivalency of the claims are intended to be embraced therein.

INDUSTRIAL APPLICABILITY

The mask according to the present invention can be used in various applications including those in which conventional masks are used.

The invention claimed is:

1. A mask adapted to be worn on a face, the mask comprising:

a transparent main body that covers at least a portion of the face, wherein the transparent main body comprises a resin film having air permeability through a thickness of the resin film, the resin film is a non-porous film having through holes extending through the thickness of the resin film, the resin film of the transparent main body is composed of a transparent material, the diameter of the through holes is 2 μm to 30 μm, the density of the through holes in the resin film is 10 holes/cm' to $1\times10^8$ holes/$cm^2$, and the air permeability of the resin film is provided solely through the through holes.

2. The mask according to claim 1, wherein the through holes extend in a direction perpendicular to a principal surface of the resin film.

3. The mask according to claim 1, wherein a ratio t/R is 1 to 10000, where R denotes the diameter of the through holes and t denotes the thickness of the resin film.

4. The mask according to claim 1, wherein the air permeability through the thickness of the resin film, as determined by Frazier number measured according to JIS L 1096, is at least 10 $cm^3/(cm^2\cdot sec)$.

5. The mask according to claim 1, wherein a sound pressure loss across the resin film at a frequency of 1 kHz is at most 5 dB.

6. The mask according to claim 1, wherein a total light transmittance of the resin film, as measured according to JIS K 7361, is at least 60%.

7. The mask according to claim 1, wherein the resin film is composed of at least one material selected from polyethylene terephthalate, polycarbonate, polyimide, polyethylene naphthalate, and polyvinylidene fluoride.

8. The mask according to claim 1, wherein the transparent main body of the mask provides an exterior front face of the mask and an exterior back face of the mask, which opposes the front face of the mask; and the through holes extend continuously from the exterior front face of the mask to the exterior back face of the mask.

9. The mask according to claim 8, wherein the diameter of the through holes decrease continuously from the exterior front face of the mask to the exterior back face of the mask.

10. The mask according to claim 8, wherein longitudinal axes of the through holes are inclined with respect to the exterior front face of the mask and the exterior back face of the mask.

11. The mask according to claim 8, wherein longitudinal axes of at least some of the through holes intersect each other within the resin film.

12. A mask adapted to be worn on a face, the mask comprising:

a transparent main body that covers at least a portion of the face, wherein the transparent main body comprises a resin film having air permeability through a thickness of the resin film, the resin film is a non-porous film having through holes extending through the thickness of the resin film, the resin film of the transparent main body is composed of a transparent material, the diameter of the through holes is 0.01 μm to 30 μm, the density of the through holes in the resin film is 10 holes/cm' to $1\times10^8$ holes/$cm^2$, and the air permeability of the resin film is provided solely through the through holes, wherein the transparent main body of the mask provides an exterior front face of the mask and an exterior back face of the mask, which opposes the front face of the mask, wherein the through holes extend continuously from the exterior front face of the mask to the exterior back face of the mask, and wherein a central longitudinal axis of each of the through holes is inclined with respect to the exterior front face of the mask and the exterior back face of the mask.

13. A mask adapted to be worn on a face, the mask comprising:

a transparent main body that covers at least a portion of the face, wherein the transparent main body comprises a resin film having air permeability through a thickness of the resin film, the resin film is a non-porous film having through holes extending through the thickness of the resin film, the resin film of the transparent main body is composed of a transparent material, the diameter of the through holes is 0.01 μm to 30 μm, the density of the through holes in the resin film is 10 holes/cm' to $1\times10^8$ holes/cm', and the air permeability of the resin film is provided solely through the through holes, wherein the transparent main body of the mask provides an exterior front face of the mask and an exterior back face of the mask, which opposes the front face of the mask, wherein the through holes extend continuously from the exterior front face of the mask to the exterior back face of the mask, and wherein a central longitudinal axis of at least one of the through holes intersect a central longitudinal axis of at least another of the through holes at a position within the resin film.

* * * * *